US009522812B2

(12) United States Patent
Otsuka

(10) Patent No.: US 9,522,812 B2
(45) Date of Patent: Dec. 20, 2016

(54) RAISABLE-LOWERABLE MEMBER FOR CRANE

(71) Applicant: Kobelco Cranes Co., Ltd., Shinagawa-ku (JP)

(72) Inventor: Hiroyuki Otsuka, Hyogo (JP)

(73) Assignee: KOBELCO CRANES CO., LTD., Shinagawa-ku (JP)

( * ) Notice: Subject to any disclaimer, the term of this patent is extended or adjusted under 35 U.S.C. 154(b) by 171 days.

(21) Appl. No.: 14/163,340

(22) Filed: Jan. 24, 2014

(65) Prior Publication Data

US 2014/0209552 A1 Jul. 31, 2014

(30) Foreign Application Priority Data

Jan. 29, 2013 (JP) ..... 2013-014506

(51) Int. Cl.
*B66C 23/30* (2006.01)
*B66C 23/36* (2006.01)

(52) U.S. Cl.
CPC ..... *B66C 23/365* (2013.01)

(58) Field of Classification Search
CPC ..... B66C 23/26; B66C 23/365; B66C 23/38; B66C 23/44; B66C 23/68; B66C 23/70
See application file for complete search history.

(56) References Cited

U.S. PATENT DOCUMENTS 3,792,781 A 2/1974 Blase et al.
5,199,586 A * 4/1993 Pech ..... B66C 23/70 212/175

(Continued)

FOREIGN PATENT DOCUMENTS

CN 101618837 A 1/2010
DE 1 247 585 B 8/1967

(Continued)

OTHER PUBLICATIONS

Combined Chinese Office Action and Search Report issued Jul. 16, 2015 in Patent Application No. 201410043355.9 (with partial English language translation and English translation of categories of cited documents).

(Continued)

*Primary Examiner* — Emmanuel M Marcelo
(74) *Attorney, Agent, or Firm* — Oblon, McClelland, Maier & Neustadt, L.L.P.

(57) ABSTRACT

Provided are a raisable-lowerable member capable of shortening a time required for assembling and disassembling of a crane, and a crane comprising the raisable-lowerable member. The raisable-lowerable member comprises: a boom attachable to an upper slewing body of the crane turnably about a boom-pivot-turn-axis in a raising-lowering direction; and a mast to be driven so as to be turned about a mast pivot-turn-axis parallel to the boom-pivot-turn-axis. The boom includes a boom body, a boom foot joined to a basal end of the boom body and adapted to be attached to the upper slewing body turnably about the boom-pivot-turn-axis, and a mast mounting portion joined to the basal end of the boom body. The mast has a basal end which includes a mast foot to be attached to the mast mounting portion turnably about the mast pivot-turn-axis.

17 Claims, 9 Drawing Sheets

(56) References Cited

U.S. PATENT DOCUMENTS

| | | | | |
|---|---|---|---|---|
| 5,487,479 | A * | 1/1996 | Pech | B66C 23/70 212/177 |
| 6,062,405 | A | 5/2000 | Pech et al. | |
| 6,702,132 | B1 * | 3/2004 | Moore | B66C 23/62 212/175 |
| 8,936,167 | B2 * | 1/2015 | Ishihara | B66C 23/365 212/180 |
| 2009/0139948 | A1 * | 6/2009 | Holly | B66C 23/70 212/292 |
| 2010/0072155 | A1 * | 3/2010 | Foust | B66C 23/365 212/175 |
| 2010/0072156 | A1 * | 3/2010 | Mentink | B66C 23/82 212/196 |
| 2010/0213155 | A1 * | 8/2010 | Hanahara | B66C 23/365 212/294 |
| 2010/0243595 | A1 * | 9/2010 | Walker | B66C 23/26 212/294 |
| 2012/0067840 | A1 * | 3/2012 | Walker | B66C 23/70 212/177 |
| 2012/0152878 | A1 * | 6/2012 | Ishihara | B66C 23/365 212/280 |

FOREIGN PATENT DOCUMENTS

| | | | |
|---|---|---|---|
| GB | 786597 | A | 11/1957 |
| JP | S39-011719 | B | 6/1964 |
| JP | 10-139375 | A | 5/1998 |
| JP | 11-43290 | A | 2/1999 |
| JP | 2010-018355 | A | 1/2010 |
| JP | 2010-195542 | A | 9/2010 |
| JP | 2012-116605 | A | 6/2012 |

OTHER PUBLICATIONS

Combined Chinese Office Action and Search Report issued on Feb. 29, 2016 in Patent Application No. 201410043355.9 (with English summary and English language translation of categories of cited documents).

Japanese Office Action issued on Sep. 27, 2016 in Japanese Patent Application No. 2013-014506 w/English translation.

* cited by examiner

RAISABLE-LOWERABLE MEMBER FOR CRANE

BACKGROUND OF THE INVENTION

1. Field of the Invention

The present invention relates to a raisable-lowerable member for a crane, including a boom.

2. Description of the Background Art

A conventional crane comprises: an upper slewing body constituting a crane main body; a boom pivot turnably attached to the upper slewing body so as to be able to be raised and lowered; and a mast attached to the upper slewing body pivot turnably about an axis parallel to a pivot-turn-axis of the boom, wherein a distal end of the boom and a distal end of the mast are joined together via a guy line to turn the boom in a raising-lowering direction in interlocking relation with the turning of the mast, as disclosed, for example, JP 2010-195542A (hereinafter referred to as "Patent Document 1") and JP 2010-18355A (hereinafter referred to as "Patent Document 2").

In this type of crane, during disassembling of the crane for transportation, there can be a case of not only detaching the upper slewing body and the boom from each other but also detaching the upper slewing body and the mast from each other. For example, in a situation where leaving the upper slewing body and the mast mutually mounted to each other prevents them from avoiding a problem of exceeding a size limit or a weight limit during transportation on public roads, the upper slewing body and the mast have to be detached from each other. In this case, re-assembling the crane after the transportation requires re-attaching of the upper slewing body and the mast together. Thus detaching and re-attaching the upper slewing body and the mast are not easy, involving a problem of taking a lot of time for operations for assembling and disassembling of the crane.

SUMMARY OF THE INVENTION

It is an object of the present invention to provide a raisable-lowerable member for a crane, which member includes a boom and a mast for raising and lowering the boom and allowing the crane to be assembled and disassembled in a shortened time, and a crane comprising the raisable-lowerable member.

Provided by the present invention is a raisable-lowerable member to be attached to an upper slewing body of a crane in a raisable and lowerable manner, the raisable-lowerable member comprising: a boom to be attached to the upper slewing body turnably about a boom-pivot-turn-axis in a raising-lowering direction; and a mast to be driven so as to be turned about a mast-pivot-turn-axis parallel to the boom-pivot-turn-axis to raise and lower the boom. The boom has a boom body, a boom foot joined to a basal end of the boom body and adapted to be attached to the upper slewing body turnably about the boom-pivot-turn-axis, and a mast mounting portion joined to the basal end of the boom body. The mast has a basal end which includes a mast foot to be attached to the mast mounting portion turnably about the mast pivot-turn-axis.

The present invention also provides a crane comprising a crane main body including an upper slewing body, and the above raisable-lowerable member. The boom foot of the boom in the raisable-lowerable member is attached to the upper slewing body so as to allow the boom to be turned about the boom-pivot-turn-axis in the raising-lowering direction.

DESCRIPTION OF THE PREFERRED EMBODIMENTS

With reference to FIGS. 1 to 5 will be described a crane according to a first embodiment of the present invention.

Figure 1:
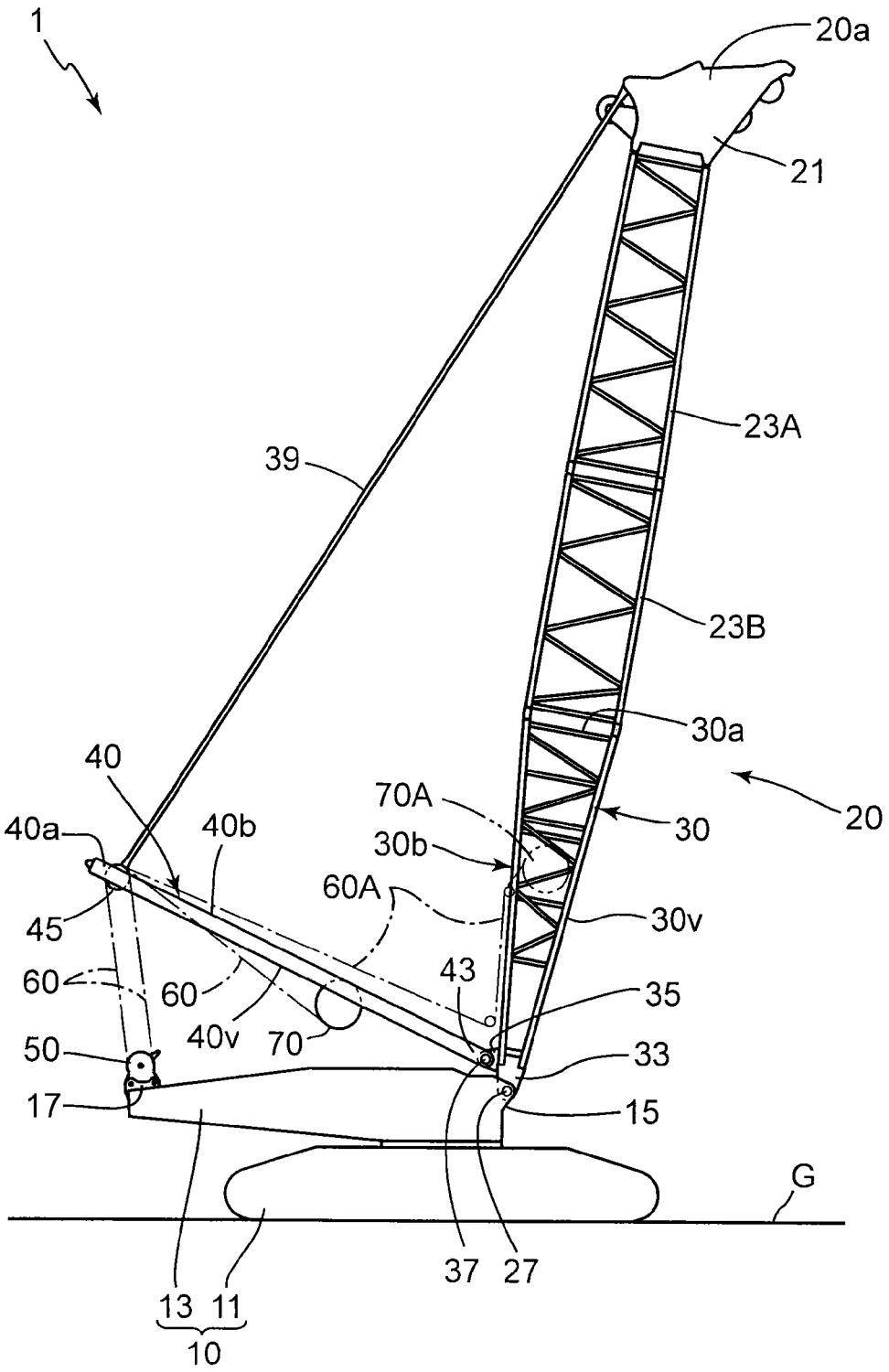
FIG. 1 is a side view of a crane according to a first embodiment of the present invention.
Figure 2:
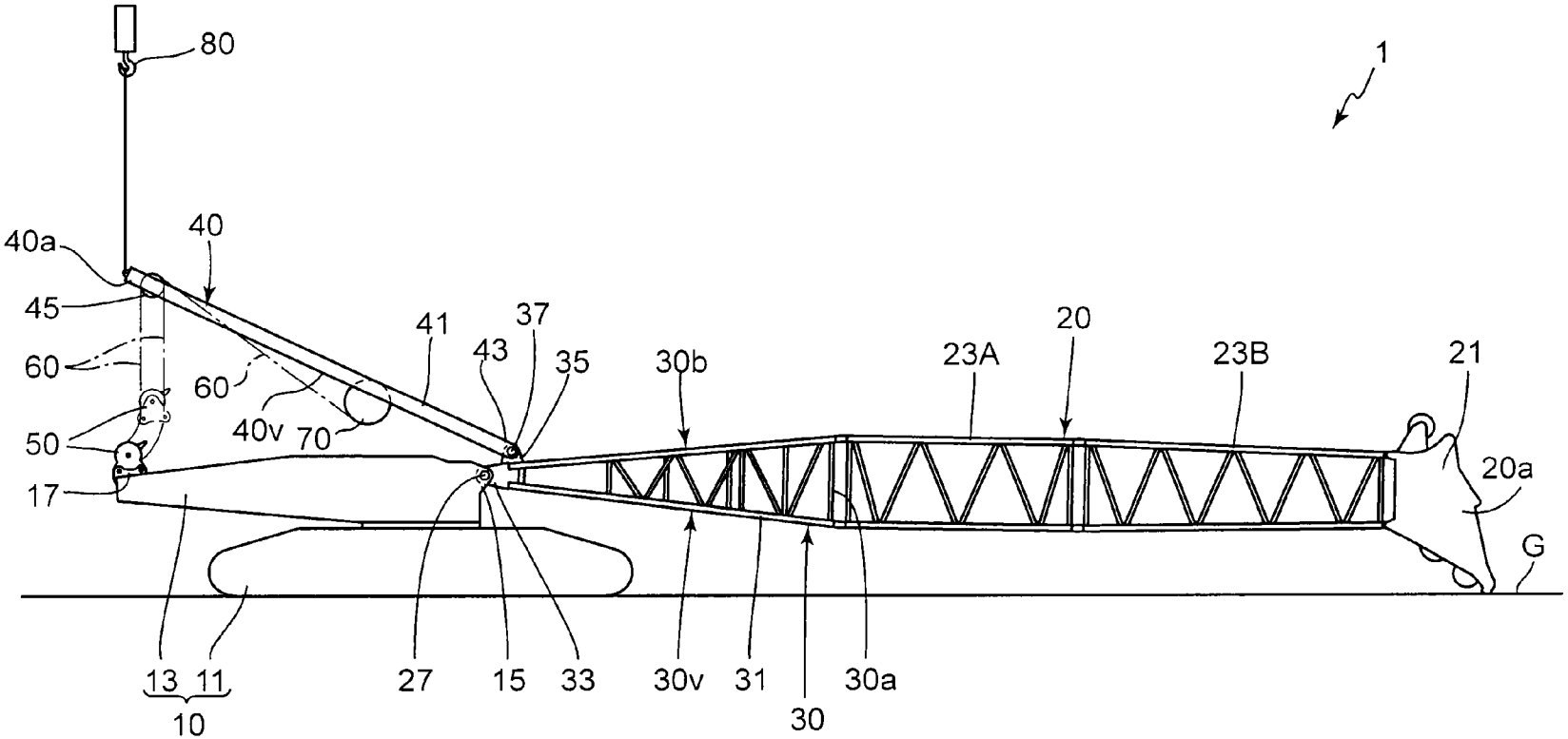
FIG. 2 is a side view showing a state where a boom of the crane shown in FIG. 1 has been lowered and laid down.
Figure 3:
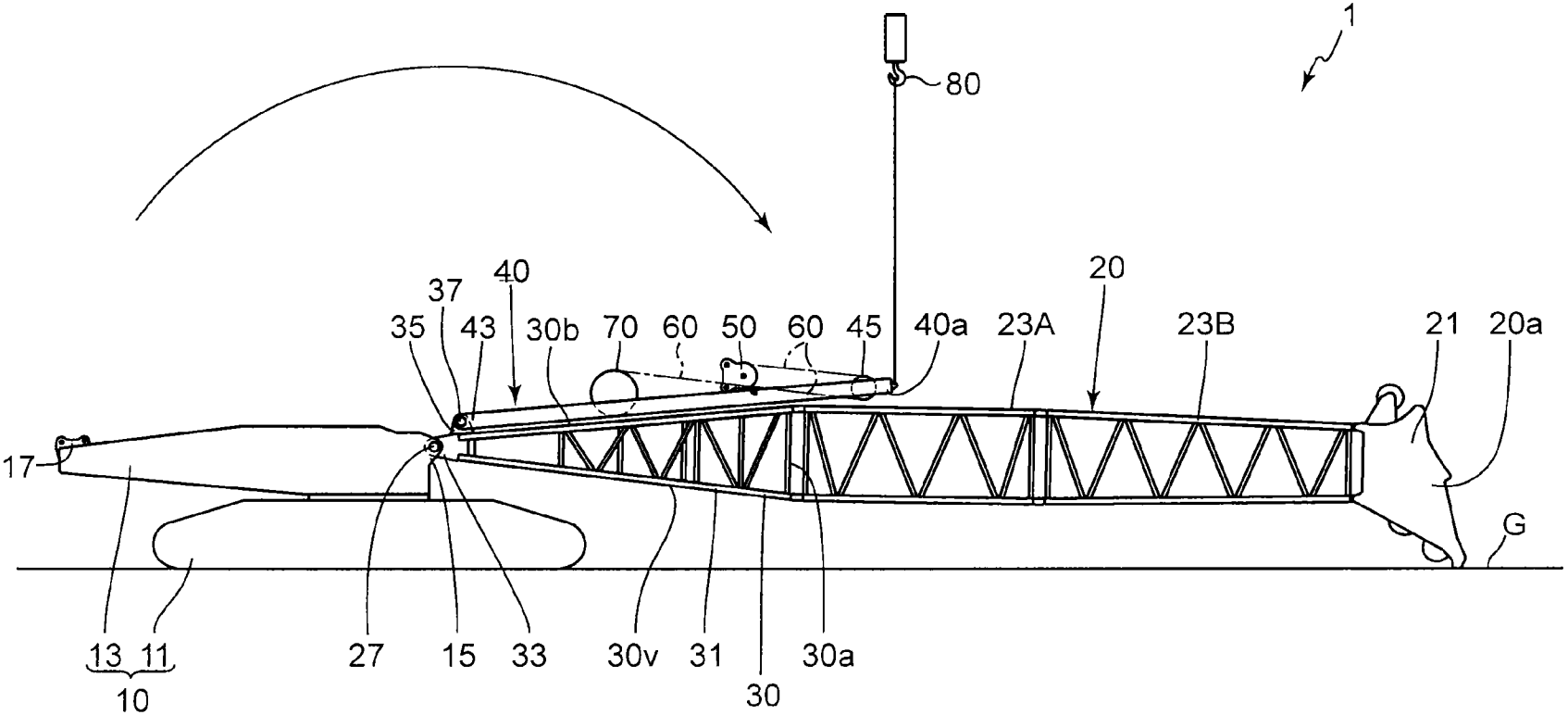
FIG. 3 is a side view showing a state where a mast of the crane shown in FIG. 1 is laid down on the boom.

FIGS. 1 to 3 show a crane 1, which is a construction machine for a construction working or the like, such as a mobile crane. The crane 1 comprises a crane main body 10, a boom 20, a guy line 39, a mast 40, an upper spreader 45, a lower spreader 50, a rope 60, and a winch 70.

The crane main body 10 comprises a lower traveling body 11 and an upper slewing body 13. The lower traveling body 11 is a section capable of travelling on the ground G. Although the lower traveling body 11 shown in FIG. 1 is a crawler type, a lower traveling body for use in the present invention may be a wheel type.

The upper slewing body 13 is installed on the lower traveling body 11 so as to be slewable. The upper slewing body 13 includes a boom mounting bracket 15 and a lower-spreader mounting bracket 17. In the following description, as viewed in a longitudinal direction of the upper slewing body 13, a side of the upper slewing body provided with the boom mounting bracket 15 will be referred to as "front side of the upper slewing body", and a side of the upper slewing body provided with the lower-spreader mounting bracket 17 will be referred to as "rear side of the upper slewing body".

The boom mounting bracket 15 is a member for attaching the boom 20 to the upper slewing body 13. The boom mounting bracket 15 is provided at a front end of the upper slewing body 13.

The lower-spreader mounting bracket 17 is a member for mounting (fixing) the lower spreader 50 to the upper slewing body 13. The lower-spreader mounting bracket 17 is provided to an upper surface of a rear end of the upper slewing body 13.

The boom 20 is a structural module for lifting a non-shown load therefrom. The boom 20 is attached to the upper slewing body 13 turnably in a raising-lowering direction, that is, turnably about a horizontal boom-pivot-turn-axis in an up-down direction. For details, the boom 20 is attached to the boom mounting bracket 15 of the upper slewing body 13. The boom 20 is raised and lowered according to after-mentioned pivot turning drive of the mast 40. In this embodiment, the boom 20 is a lattice boom having a lattice structure. The boom 20 has a shape extending in one direction, having an end on the side of a distal end thereof, namely, a boom distal end 20*a*.

The boom 20 is capable of being disassembled into a plurality of members aligned in a longitudinal direction (axial direction) thereof. Specifically, the boom 20 includes an upper boom member 21, two intermediate boom members 23A, 23B, and a lower boom member 30, which are aligned in this order from the side of the distal end thereof. Thus, in this boom 20, the lower boom member 30 can be separated from the distal-end-side members 21, 23A, 23B closer to the distal end of the boom 20*a* than the lower boom member 30. The boom in the present invention is, meanwhile, not limited to a type including the two intermediate boom members 23A, 23B. The boom in the present invention may comprise one intermediate boom member or three or more intermediate boom members, or may include no intermediate boom members.

Among the plurality of elements (unit boom members) of the axially-disassemblable boom 20, the lower boom member 30 is located closest to a basal end of the boom 20, i.e., closest to the upper slewing body 13. The lower boom member 30 includes: a distal end 30*a*; and a lower boom member's back side surface 30*b* and a lower boom member's belly side surface 30*v* corresponding to an upper surface and a lower surface of the lower boom member 30, respectively, in a state where the lower boom member 30 (boom 20) has been lowered and laid down parallel to the ground G as shown in FIG. 2.

The lower boom member 30 comprises: a lower boom member body 31 constituting a boom body; a boom foot 33; and a pair of right and left mast mounting brackets 35.

Figure 5:
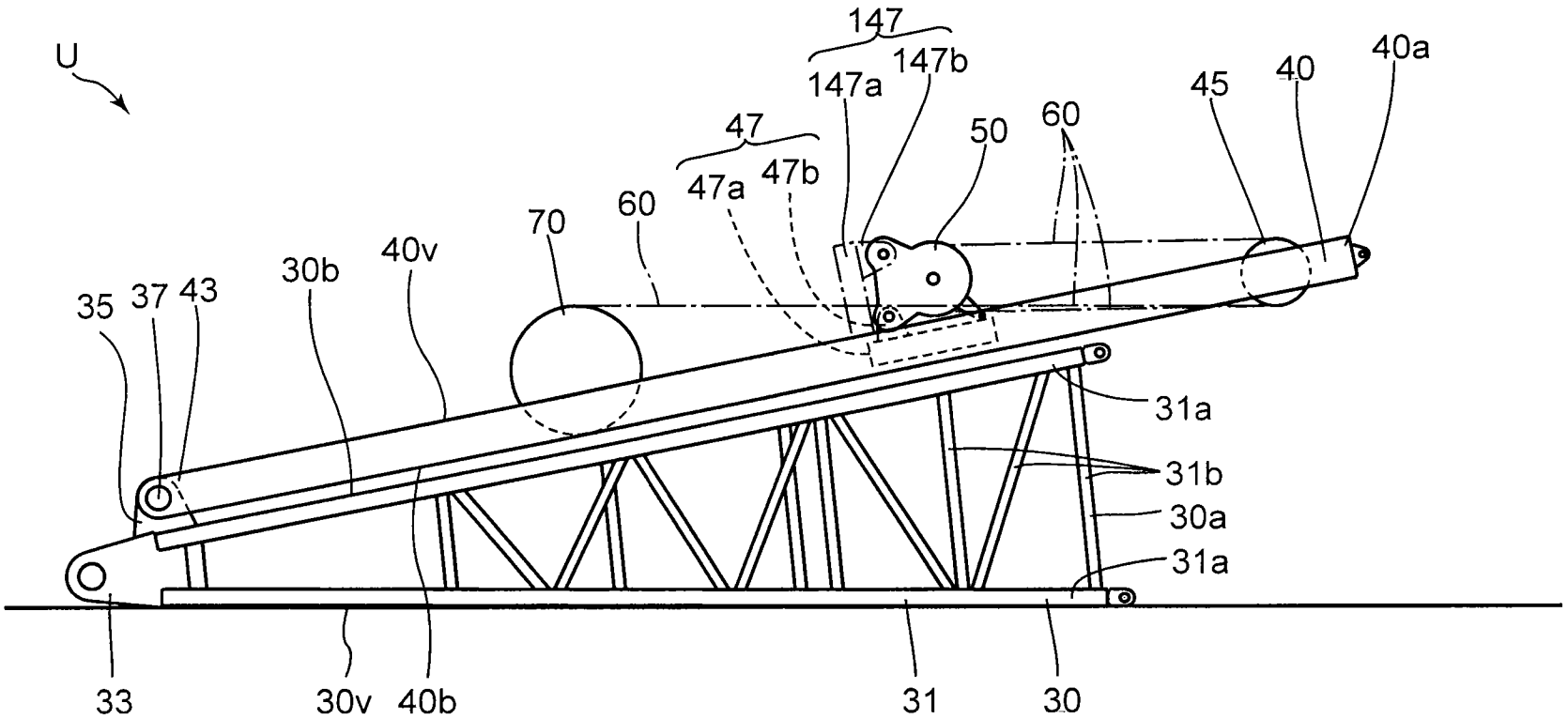
FIG. 5 is a side view showing transportation postures of a lower boom member showing in FIG. 1, the mast and others.
Figure 7:
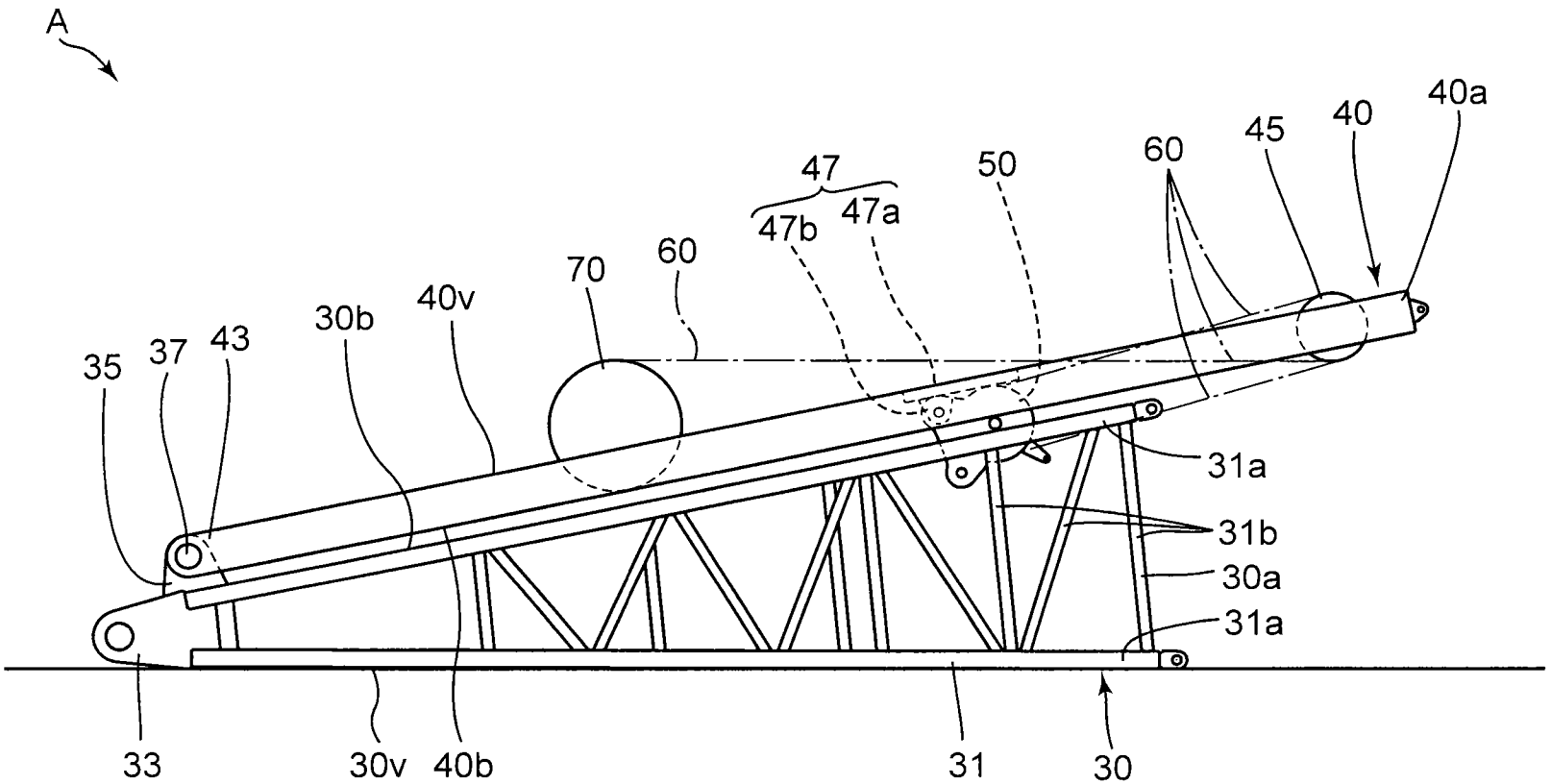
FIG. 7 is a side view showing transportation postures of the lower boom member shown in FIG. 6, a mast and others.
Figure 9:
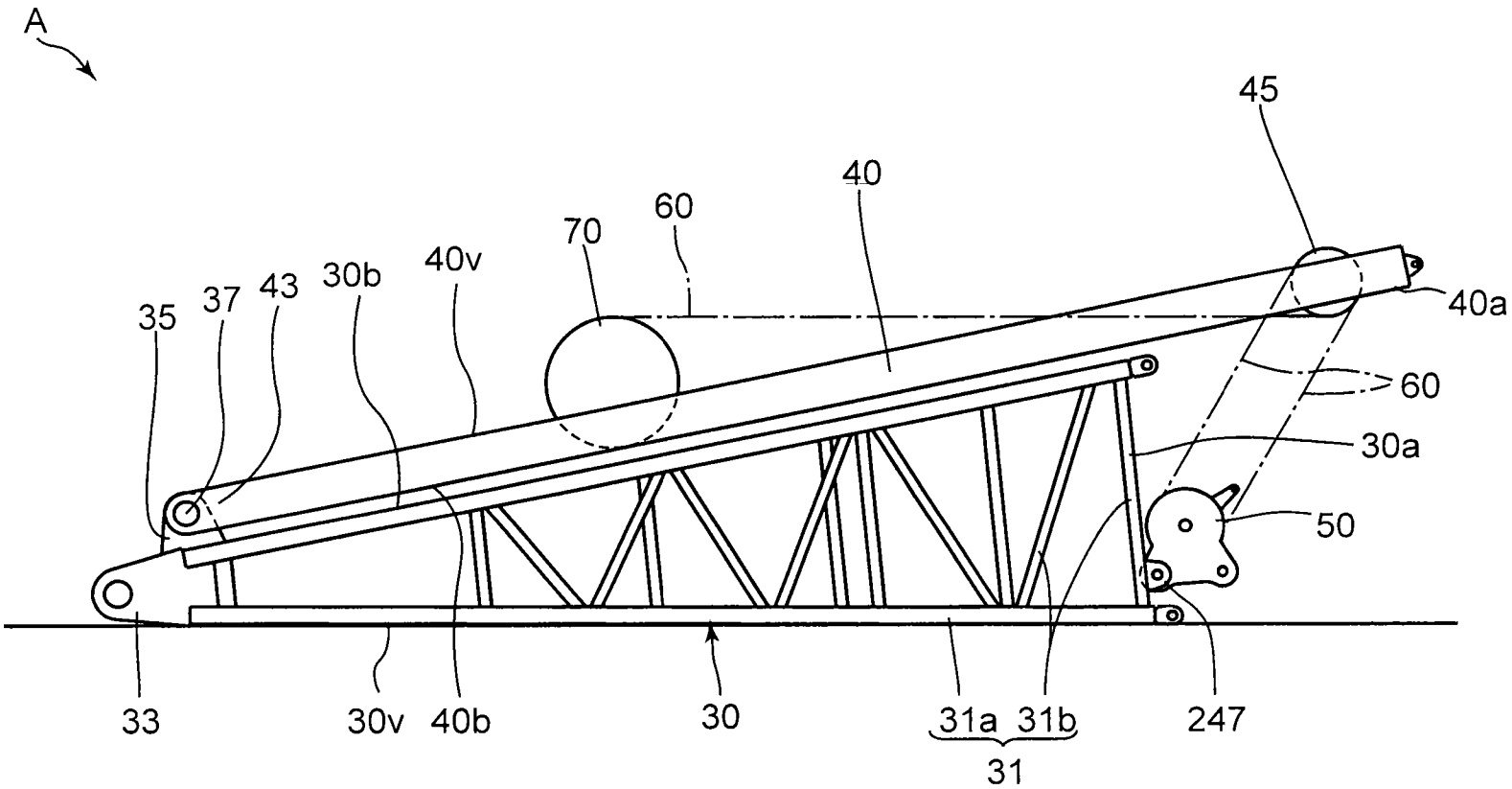
FIG. 9 is a side view showing transportation postures of the lower boom member shown in FIG. 8, a mast and others.

As shown in FIG. 5, the lower boom member body 31 is such a taper-shaped structural member that the distance between the lower boom member's back side surface 30*b* and the lower boom member's belly side surface 30*v* gradually increases with closing to a distal end of the lower boom member 30. In short, the lower boom member body 31 is a structural member of an approximately triangular shape in side view. The lower boom member body 31 includes a plurality of main pipes 31*a* and a plurality of sub-pipes 31*b*. The main pipes 31*a* are disposed at respective positions corresponding to four corners in a cross-section of the lower boom member body 31, i.e., a section perpendicular to an axial direction thereof. Each of the sub-pipes 31*b* is disposed between ones of the main pipes 31*a* adjacent to each other to interconnect the adjacent main pipes 31*a*. FIGS. 5, 7 and 9 are provided with reference codes for only a part of the plurality of sub-pipes 31*b*.

As shown in FIG. 1, the boom foot 33 is joined to a basal end of the lower boom member body 31, in other words, joined to a basal end of the entire boom 20. The boom foot 33 is a portion capable of being turnably attached to the upper slewing body 13. For details, the boom foot 33 is attached to the boom mounting bracket 15 through a pin, namely, a boom foot pin 27. The boom foot pin 27 has an axis equivalent to an axis of turning of the boom 20 (of the lower boom member 30) with respect to the upper slewing body 13, i.e., a boom-pivot-turn-axis.

The right and left mast mounting brackets 35 are respective portions to which a pair of aftermentioned mast feet 43 making up a basal end of the mast 40 can be turnably attached, making up a "mast mounting portion" joined to the basal end of the boom 20. As shown in FIG. 2, the mast 40 is turnably attached to the mast mounting brackets 35. Each of the mast mounting brackets 35 is disposed at the basal end of the lower boom member body 31 so as to protrude outwardly beyond the lower boom member's back side surface 30*b* of the lower boom member body 31. Specifically, in the state of lowering and laying down the boom 20 as mentioned above, the mast mounting bracket 35 protrudes from the basal end of the lower boom member body 31 upwardly beyond the lower boom member's back side surface 30*b*. The term "basal end" includes not only a basal end in a strict or narrow sense but also a region adjacent to the basal end. For suppressing deterioration in hoisting capability of the crane 1, it is desirable that each of the mast mounting brackets 35 is positioned close to the basal end of the boom 20 as possible. Specifically, the mast mounting brackets 35 are disposed adjacent to the boom foot 33. For example, the mast mounting brackets 35 may be provided at respective basal ends of the two main pipes 31*a* (see FIG. 5) constituting the lower boom member's back side surface 30*b*.

In this embodiment, each of the right and left mast mounting brackets 35 has at least one plate formed with a pin hole. Each of the mast mounting brackets 35 is disposed at a position to avoid interference with another member, such as the boom mounting bracket 15, when the boom 20 is turned about the boom foot 33. In the present invention, the number of the "mast mounting portions" may be one.

As shown in FIG. 1, the guy line 39 interconnects the boom distal end 20*a* (of the upper boom member 21) and a mast distal end 40*a*, which is an end of the mast 40 on the side a distal end thereof. For example, the guy line 39 can be formed of a wire, or a plurality of link members aligned in a specific direction and connected to each other.

Figure 6:
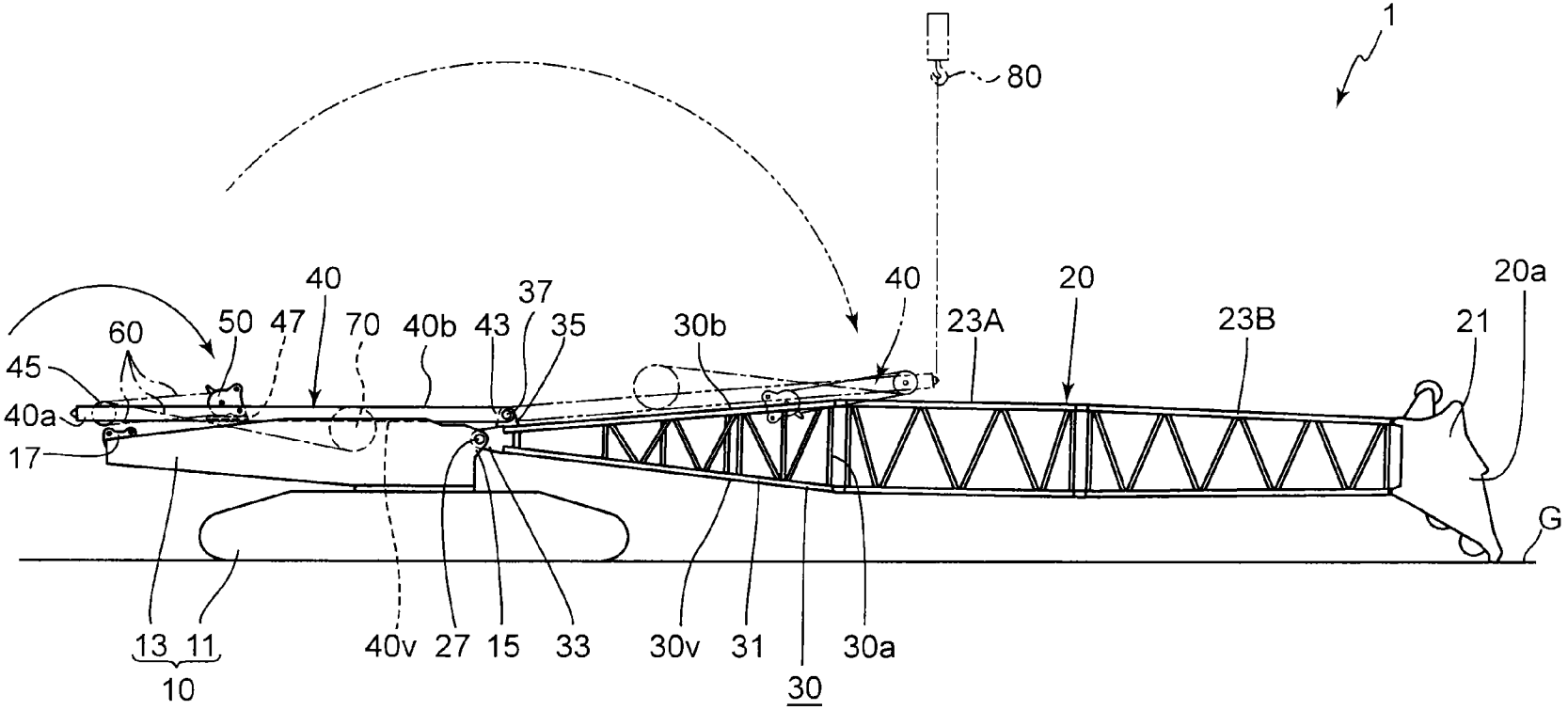
FIG. 6 is a side view of a crane according to a second embodiment of the present invention in a state where a boom thereof has been lowered and laid down.

The mast 40 is a structural module for raising and lowering the boom 20 via the guy line 39. In the assembled crane, the mast 40 is located rearward of the boom 20 (on the rear side of the upper slewing body 13). The mast feet 43, which is the basal end of the mast 40 as after-mentioned, are attached to the mast mounting brackets 35 of the lower boom member 30 through two mast foot pins 37, respectively. The mast 40 is thus attached to the boom 30 turnably, i.e., raisably and lowerably, about the mast foot pins 37. As shown in FIG. 6, the mast 40 has a mast's back side surface 40*b* and a mast's belly side surface 40*v* corresponding to an upper surface and a lower surface, respectively, in a state where the mast 40 is laid down on the upper slewing body 13.

Figure 4:
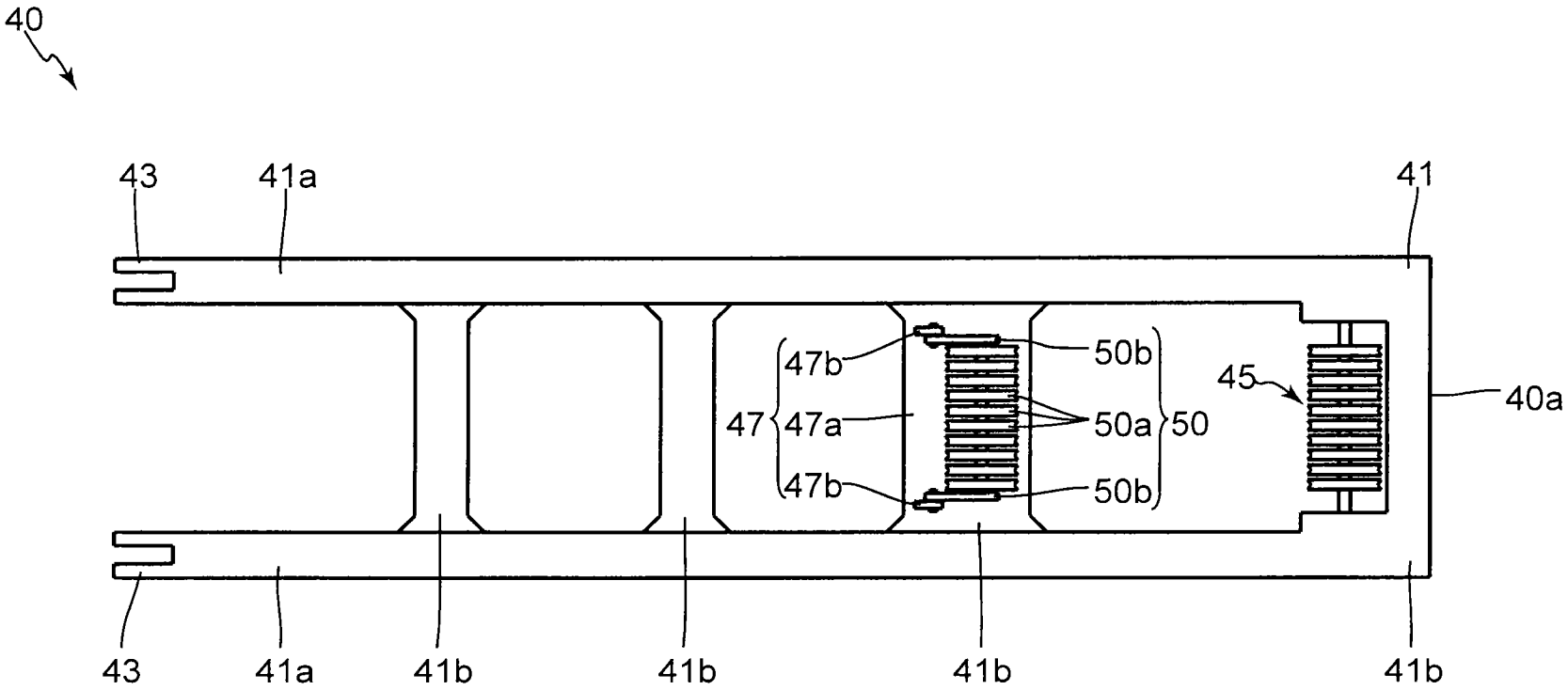
FIG. 4 is a top plan view of the mast and others shown in FIG. 3.

As shown in FIG. 1, the whole of the mast 40 is axially continuous, being incapable of being axially disassembled. In this embodiment, the mast 40 has a length, i.e., an axial dimension, approximately equal to a longitudinal dimension of the upper slewing body 13. As shown in FIG. 4, the mast 40 includes a mast body 41 and a pair of right and left mast feet 43.

The mast body 41 is a main body (frame section) of the mast 40. The mast body 41 comprises two rod-shaped posts 41*a* and at least one coupling member 41*b* interconnecting the posts 41*a*. Each of the posts 41*a* is, for example, a box-like structural member, such as a hollow polygonal or circular column. Thus, the mast 40 in this embodiment is, so to say, a "box mast". The two posts 41*a* are arranged side-by-side, for example, in a right-left direction in parallel to each other. Coupling members 41*b* are disposed between the two mast posts 41*a* at the several points. The coupling member 41*b* may have any suitable shape, such as a plate-like or box-like shape.

The mast feet 43 make up the basal end of the mast 40. As shown in FIG. 1, the mast feet 43 are attached to respective mounting brackets 35 of the lower boom member 30. The mast feet 43 in this embodiment are joined to respective basal ends of the posts 41*a*, as shown in FIG. 4. In this embodiment, each of the mast feet 43 is formed by at least one plate-like portion integral with a member making up a corresponding one of the posts 41*a*, or at least one plate fixed to a basal end of the post 41*a*. Each of the mast feet 43 is formed with a pin hole. As shown in FIG. 1, the mast foot pins 37 are inserted through respective pin holes of the mast feet 43 and the corresponding mast mounting brackets 35, thus interconnecting the mast 40 and the boom 20 relatively turnably about a mast pivot-turn-axis parallel to the boom-pivot-turn-axis. The axis of the mast foot pin 37 is, thus, equivalent to "mast pivot-turn-axis" set forth in the appended claims. The number of the "mast feet" according to the present invention, may be one.

The upper spreader 45 is supported by the distal end of the mast body 41, namely, the mast distal end 40*a*. Specifically, as shown in FIG. 4, the upper spreader 45 comprises a plurality of sheaves supported by the mast body 41 so as to be rotatable about an axis parallel to the boom-pivot-turn-axis and the mast pivot-turn-axis.

The crane 1 further comprises a lower-spreader mounting portion 47, which is a portion fixed to the mast 40 and configured to allow the lower spreader 50 to be attached to the lower-spreader mounting portion 47 when the lower boom member 30 and the mast 40 of the raisable-lowerable member as shown in FIG. 5 are transported as described later, that is, a portion constituting a lower-spreader holding portion capable of holding the lower spreader 50. Preferably, the lower-spreader mounting portion 47 is capable of, during transportation, fixedly holding the lower spreader 50 so as to prevent the lower spreader 50 from wobbling movement. In this embodiment, the lower-spreader mounting portion 47 includes a frame 47*a* and a bracket 47*b*.

The frame 47*a* is a structural member on which the lower spreader 50 can be placed. In this embodiment, the frame 47*a* is disposed between the two posts 41*a* constituting the mast body 41 so as to interconnect the posts 41*a*. The frame 47*a* may have any suitable shape, such as a plate-like or box-like shape.

In this embodiment, the bracket 47*b* is disposed at each of right and left positions on the frame 47. In this embodiment, each of the brackets 47*b* is formed of a plate member, where a pin hole is formed. Each of the brackets 47*b* has the same shape as that of at least a part of corresponding one of the lower-spreader mounting brackets 17 of the upper slewing body 13 shown in FIG. 1. Specifically, the pin hole of the bracket 47*b* shown in FIG. 4 has a size equal (or approximately equal) to that of the pin hole of the lower-spreader mounting bracket 17 (see FIG. 1). The number of the pin holes in the bracket 47*b* may be less than that of the pin holes in the lower-spreader mounting bracket 17 (see FIG. 1). For example, in the case where the number of the pin holes in each of the lower-spreader mounting brackets 17 is two, that is, a total number of the pin holes in the lower-spreader mounting brackets 17 is four, the number of the pin holes in each of the brackets 47*b* may be two or one, that is, a total number of the pin holes in the brackets 47*b* may be four or less.

The lower spreader 50 is attachable and detachable with respect to the upper slewing body 13 shown in FIG. 1. As shown in FIG. 4, the lower spreader 50 comprises a plurality of lower sheaves 50*a*, and a frame 50*b*. The frame 50*b* pivotally supports the lower sheaves 50*a* so as to allow them to be rotated about an axis parallel to the boom-pivot-turn-axis and the mast-pivot-turn-axis. The frame 50*b* is attachable and detachable with respect to the lower-spreader mounting brackets 17 of the upper slewing body 13 shown in FIG. 1. The frame 50*b* is also attachable and detachable with respect to the lower-spreader mounting portion 47 shown in FIG. 4. FIG. 4 is provided with reference codes for only a part of the plurality of lower sheaves 50*a*. FIG. 4 involves an omission of the winch 70 shown in FIG. 3.

As shown in FIG. 1, the rope 60 is reeved between (the sheaves of) the upper spreader 45 and (the lower sheaves 50*a* of) the lower spreader 50. In each figure, an example of a path of the rope 60 is indicated by the one-dot chain line. The path of the rope 60 can be variously set by use of a sheave or the like.

The winch 70 is a device to wind and unwind the rope 60 having been reeved between the upper spreader 45 and the lower spreader 50 to thereby turn the mast 40 about the mast pivot-turn-axis. Winding the rope 60 by the winch 70 reduces a distance between the upper spreader 45 and the lower spreader 50 fixed to the upper slewing body 13. This turns the mast 40, toward the rear side of the upper slewing body 13, about the mast foot pins 37 penetrating through the mast feet 43, thus turning the boom 20 connected to the mast 40 via the guy line 39, toward the rear side of the upper slewing body 13, about the boom foot pin 27 penetrating through the boom foot 33, that is, raising the boom 20. Unwinding the rope 60 by the winch 70 causes each member to make a reverse movement, thus turning the boom 20, toward the front side of the upper slewing body, about the boom foot pin 27, that is, lowering the boom 20.

The winch 70 according to the first embodiment is attached and fixed to the mast 40, that is, mounted to the mast 40. As shown in FIG. 2, the winch 70 in this embodiment is arranged on the side of the mast's belly side surface 40*v* so as to be completely or almost completely prevented from protruding outside the mast 41 beyond the mast's back side surface 40*b*. This arrangement prevents or brings away the winch 70 from interference with the lower boom member 30 in a posture of raisable-lowerable member during transportation as shown in FIG. 5.

In the present invention, the winch may be mounted not to the mast but to the boom. For example, the winch may be mounted to the lower boom member 30, like a winch 70A indicated by the two-dot chain line in FIG. 1. In this case, a rope 60A unwound from the winch 70A attached to the lower boom member 30 can be led to the upper spreader 45, for example, while turning up in a vicinity of the boom foot 33. The following description will be made about a case of attaching the winch 70 to the mast 40 as indicated by the solid line in FIG. 1.

There will be explained below a method for disassembling and assembling the crane 1, and a method for transportation of a portion of the raisable-lowerable member which portion includes the lower boom member 30 and the mast 40.

Firstly will be explained a method of disassembling the crane 1 in order of step. The crane 1 can be disassembled, for example, through the following [Step 1-*a*] to [Step 1-*h*].

[Step 1-*a*] As shown in FIG. 2, the boom 20 is lowered and laid down to bring the boom distal end 20*a* into contact with the ground G.

[Step 1-*b*] The mast 40 is lifted and held by a hook 80 (FIG. 2) equipped in a non-shown auxiliary crane other than the crane 1, causing the mast distal end 40*a* to be disposed on the rear side of the upper slewing body 13 with respect to the mast feet 43.

[Step 1-*c*] The guy line 39 shown in FIG. 1 is detached from the mast 40 and the boom 20.

[Step 1-*d*] The lower spreader 50 is detached from the lower-spreader mounting brackets 17.

[Step 1-*e*] The winch 70 is driven to wind the rope 60. This results in a state where the lower spreader 50 has been lifted up to be suspended from the upper spreader 45, as indicated by the two-dot chain line in FIG. 2. If necessary for after-mentioned [Step 1-*g*], the distance between the upper spreader 45 and the lower spreader 50 is adjusted.

[Step 1-*f*] As shown in FIG. 3, by use of the auxiliary crane, the mast 40 is turned toward the front side of the upper slewing body 13. The mast distal end 40*a* is thereby disposed on the front side of the upper slewing body 13 with respect to the mast feet 43. The mast 40 is disposed to cause the mast's back side surface 40*b* and the lower boom member's back side surface 30*b* shown in FIG. 5 to become vertically opposed to each other, in other words, to become vertically adjacent to each other, or to become parallel to each other. Thus, the mast 40 can be laid down on the lower boom member's back side surface 30*b* through turning about the mast pivot-turn-axis. As a result, the lower spreader 50 is placed on the frame 47*a* of the lower-spreader mounting portion 47, as shown in FIG. 4.

[Step 1-*g*] The frame 50*b* of the lower spreader 50 thus placed on the frame 47*a* of the lower-spreader mounting portion 47 is fixed to the brackets 47*b* of the lower-spreader mounting portion 47 by pins.

[Step 1-*h*] The boom 20 is detached from the upper slewing body 13 to obtain a transportation posture shown in FIG. 5. Specifically, the boom foot pin 27 is pulled out from the boom foot 33 of the boom 20 shown in FIG. 3, and the boom foot 33 is detached from the boom mounting bracket 15 of the upper slewing body 13. Besides, the lower boom member 30 is separated from the intermediate boom members 23A and 23B. The crane 1 can be assembled through a process reverse (or approximately reverse) to the above [Step 1-*a*] to [Step 1-*h*].

[Step 1-*i*] The lower boom member 30, the mast 40 and others are transported in the state shown in FIG. 5. Specifically, the lower boom member 30, the mast 40 attached to the lower boom member 30, and the members attached to the lower boom member 30 and the mast 40 (the lower spreader 50, the rope 60 and the winch 70), are transported as one unit U. In summary, the lower boom member 30 and the mast 40 are transported as a single unit U, wherein the mast feet 43 remain attached to the mast mounting brackets 35. This unit U is transported while the rope 60 remains reeved between the upper spreader 45 and the lower spreader 50. The unit U is transported while the lower spreader 50 is fixed to the lower-spreader mounting portion 47.

This embodiment has the following features: as shown in FIG. 5, the lower boom member 30 comprises the lower boom member body 31 (boom body), the boom foot 33 and the mast mounting brackets 35; the boom foot 33 is joined to the basal end of the lower boom member body 31 and attached to the upper slewing body 13 shown in FIG. 1 detachably and turnably about the boom-pivot-turn-axis; the mast mounting brackets 35 are fixed to the basal end of the lower boom member body 31; the mast feet 43 are attached to the mast mounting brackets 35 so as to allow the mast 40 to be turned about the mast pivot-turn-axis parallel to the boom-pivot-turn-axis, relatively to the lower boom member body 31. This feature enables the crane 1 shown in FIG. 1 to be disassembled and transported while the mast 40 remains attached to the lower boom member 30.

For details, in a state where the mast feet 43 remain attached to respective mast mounting brackets 35, it is possible not only to raise and lower the boom 20 (see FIG. 1) by the mast 40 but also to transport the lower boom member 30 and the mast 40 as a single unit while they remain mutually mounted. This enables the crane 1 shown in FIG. 1 to be transported without attaching and detaching the mast 40 with respect to the upper slewing body 13, resulting in a possibility of shortening a time required for the assembling and disassembling of the crane 1.

The aforementioned Patent Documents 1 and 2 describe cranes designed to eliminate a need for a rope winding and unwinding operation in order to shorten a time required for assembling and disassembling of the crane. More specifically, the Patent Document 1 (FIG. 9, etc.) describes a technique of dividing an upper slewing body into a front block and a rear block to allow a mast and the rear block to be transported as a single unit. Besides, the Patent Document (FIGS. 10 to 14, etc.) describes a technique of attaching a lower spreader to a mast to transport the lower spreader and the mast as a single unit. However, either of the techniques described in the Patent Documents 1 and 2 requires the mast to be detached from the upper slewing body for disassembling of the crane and to be re-attached to the upper slewing body for assembling of the crane; these operations take a lot of time. In contrast, the lower boom member 30 in the above embodiment involves no requirement for attaching and detaching the mast 40 with respect to the upper slewing body 13.

Besides, the unit U shown in FIG. 5 as an object to be transported has the following feature: the unit U includes, in addition to the lower boom member 30 and the mast 40, the upper spreader 45 provided at the mast distal end 40*a*, the lower spreader 50 attachable and detachable with respect to the upper slewing body 13 shown in FIG. 1, the rope 60 to be reeved between the upper spreader 45 and the lower spreader 50, the winch 70, and the lower-spreader mounting portion 47; the winch 70 (or the winch 70A) for winding and unwinding the rope 60 (or the rope 60A) is attached to the mast 40 (or the lower boom member 30); the lower-spreader mounting portion 47 is fixed to the mast 40 to allow the lower spreader 50 to be detachably attached to the lower-spreader mounting portion 47. This enables the lower boom member 30, the mast 40, the upper spreader 45, the lower spreader 50, the rope 60 and the winch 70 to be transported integrally as the single unit U.

In summary, it is possible to transport them as the single unit U while the rope 60 from the winch 70 remains reeved between the upper spreader 45 and the lower spreader 50. This allows the crane 1 shown in FIG. 1 to be disassembled without removing the rope 60 from the upper spreader 45 and the lower spreader 50 to thus eliminating a need for winding the rope 60 by the winch 70, and further allows the crane 1 to be re-assembled without unwinding the rope 60 from the winch 70 to reeve the rope 60 between the upper spreader 45 and the lower spreader 50, resulting in a shorten time required for the assembling and disassembling of the crane 1.

FIG. 5 indicates not only the lower-spreader mounting portion 47 but also a lower-spreader mounting portion 147 as an example of a modification thereof with a two-dot chain line. The lower-spreader mounting portion 147 includes a frame 147*a* and a bracket 147*b*. The frame 147*a* is, for example, a plate standing upright to protrude outside the mast 40 beyond the mast's belly side surface 40*v*. The bracket 147*b* is formed of a plate protruding from the frame 147*a* toward the distal end of the mast, the plate being formed with a pin hole. Alternatively, there may be provided, at a position of the bracket 47*b* in FIG. 5, a bracket similar to the bracket 147*b*, i.e., a bracket protruding from the frame 147*a*. Besides, the lower spreader 50 may be attached and fixed to both the lower-spreader mounting portion 47 and the lower-spreader mounting portion 147.

Next will be explained, with reference to FIGS. 6 and 7, a method of disassembling (assembling) a crane 1 according to a second embodiment of the present invention, and a method of transporting a raisable-lowerable member. The second embodiment shown in FIG. 7 is different from the first embodiment shown in FIG. 5, in terms of a position of a lower spreader 50 in a unit U to be transported. Furthermore, in the second embodiment shown in FIG. 6, aftermentioned [Step 2-*f*1] [Step 2-*f*2] [Step 2-*g*1] and [Step 2-*g*2] are performed, in place of [Step 1-*f*] and [Step 1-*g*] (see FIGS. 2 and 3) in the first embodiment. These differences will be described below in more detail.

[Step 2-*f*1] This step is started in a state equivalent to the state as shown in FIG. 2 just after completion of [Step 1-*e*] in the first embodiment as to the crane 1. In this step, a mast 40 is lowered toward a rear side of an upper slewing body 13 and laid down to such a position as to come into contact with an upper surface of the upper slewing body 13, as indicated by the solid line in FIG. 6.

[Step 2-*f*2] The lower spreader 50 is turned toward a front side of the upper slewing body 13, about an upper spreader 45, for example, by use of a non-shown auxiliary crane, thereby being moved to a position above a mast's back side surface 40*b*. This causes the lower spreader 50 to be disposed at a position corresponding to a lower-spreader mounting portion 47, as shown in FIG. 7.

[Step 2-*g*1] The thus moved lower spreader 50 is attached and fixed to the lower-spreader mounting portion 47. The lower-spreader mounting portion 47 has a shape allowing the lower spreader 50 to be attached thereto. For example, the lower-spreader mounting portion 47 has a bracket 47*b* (FIG. 7) protruding outwardly beyond the mast's back side surface 40*b*.

[Step 2-*g*2] The mast 40 is turned toward the front side of the upper slewing body by the auxiliary crane. This causes the mast 40 to be disposed, as indicated by the two-dot chain line in FIG. 6, so as to locate a mast distal end 40*a* thereof on the front side of the upper slewing body with respect to two mast feet 43 thereof.

Subsequently, a boom 20 is detached from the upper slewing body 13 as shown in FIG. 7 to be disassembled, similarly to [Step 1-*h*] (see FIG. 5) in the first embodiment. In this state, the lower spreader 50 is positioned lower than the lower spreader 50 in the first embodiment shown in FIG. 5, which allows a height position of the unit U in its transportation to be low.

Next will be described, with reference to FIGS. 8 and 9, a method of disassembling (assembling) a crane 1 according to a third embodiment of the present invention and a method of transporting a raisable-lowerable member. The third embodiment shown in FIG. 9 is different from the first embodiment shown in FIG. 5, in terms of a position of a lower spreader 50 in a unit U to be transported while including a lower boom member 30 and a mast 40. Furthermore, in the third embodiment, aftermentioned [Step 3-*h*1] to [Step 3-*h*4] are performed, in place of [Step 1-*h*] (see FIGS. 3 and 5) in the first embodiment. These differences will be described below in more detail.

[Step 3-*h*1] This step is started in a state equivalent to the state just after completion of [Step 1-*f*] in the first embodiment, as shown in FIG. 3. As shown in FIG. 8, the intermediate boom members 23A, 23B shown in FIG. 1 are separated from the lower boom member 30. In this state, the lower boom member 30 and an upper slewing body 13 may be connected together or may be separated from each other.

[Step 3-*h*2]

The lower spreader 50 is turned about an upper spreader 45, for example, by use of a non-shown auxiliary crane, thereby being moved from the side of a mast's belly side surface 40*v* to the side of a mast's back side surface 40*b*.

[Step 3-*h*3]

The lower spreader 50 is attached and fixed to the lower boom member 30. More specifically, the lower spreader 50 is fixed to a distal end 30*a* of the lower boom member 30. Thus, the distal end 30*a* of the lower boom member 30 makes up "lower-spreader holding portion" set forth in the appended claims. The lower spreader 50, in this embodiment, is thereby disposed at a position outward of the distal end 30*a* of the lower boom member 30 (at a position axially outside a distal end of the lower boom member 30). Alternatively, the lower spreader 50 may be disposed within the lower boom member 30.

[Step 3-*h*4]

Figure 8:
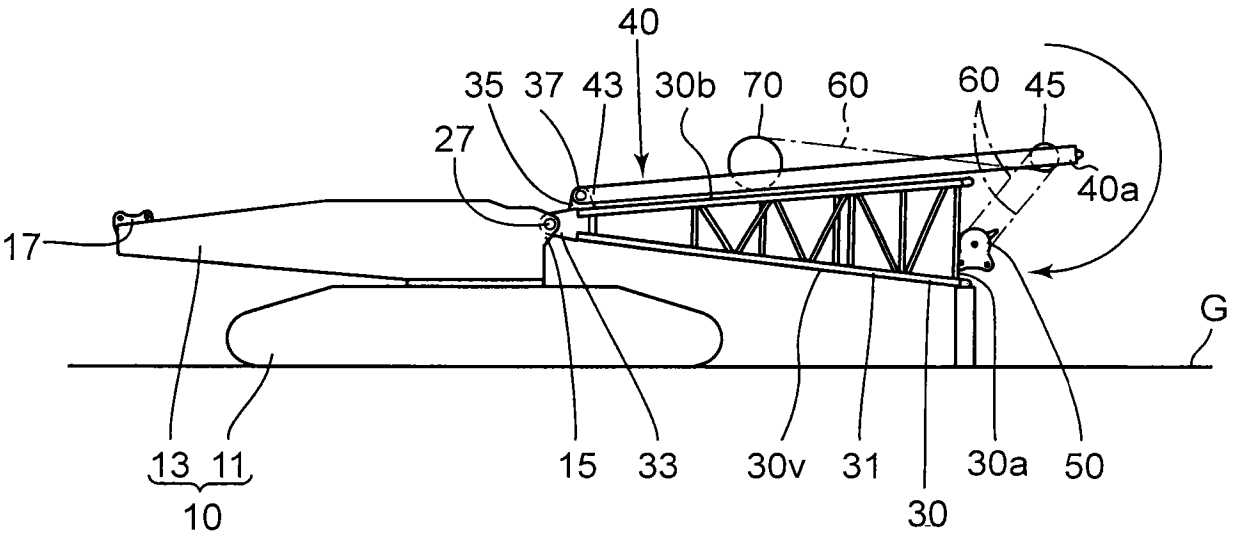
FIG. 8 is a side view of a crane according to a third embodiment of the present invention in a state where a boom thereof has been lowered and laid down.

As shown in FIG. 9, disassembly is carried out by detaching the lower boom member 30 from the upper slewing body 13 shown in FIG. 8.

As shown in FIG. 9, this embodiment includes a lower-spreader mounting portion 247, which is a portion fixed to the lower boom member 30 and configured to allow the lower spreader 50 to be attached thereto during transportation of the unit U. The lower-spreader mounting portion 247 is fixed, for example, to the distal end 30*a* of the lower boom member 30. As with the lower-spreader mounting portion 47 in the first embodiment, the lower-spreader mounting portion 247 has the same shape as that of at least a part of a lower-spreader mounting bracket 17 shown in FIG. 8. The lower-spreader mounting portion 247, in this embodiment, is fixed to a sub-pipe 31*b* constituting the distal end 30*a* of the lower boom member 30. The lower-spreader mounting portion 247, for example, includes a bracket (plate formed with a pin hole) protruding from the distal end 30*a* of the lower boom member 30 outwardly with respect to the distal end of the lower boom member 30.

It is to be understood that the present invention is not limited to the above embodiments, but various changes and modifications may be made therein. For example, a sequence of the above steps may be appropriately changed. As one example, in the third embodiment shown in FIG. 8, the intermediate boom members 23A, 23B are separated from the lower boom member 30 in [Step 3-*h*1], and then the lower boom member 30 is separated from the upper slewing body 13; this sequence however may be reversed.

As mentioned above, the present invention provides a raisable-lowerable member for a crane which includes a boom and a mast for raising and lowering the boom and makes it possible to shorten a time required for assembling and disassembling of the crane, and a crane comprising the raisable-lowerable member.

Provided by the present invention is a raisable-lowerable member to be attached to an upper slewing body of a crane in a raisable and lowerable manner, the raisable-lowerable member comprising: a boom to be attached to the upper slewing body turnably about a boom-pivot-turn-axis in a raising-lowering direction; and a mast to be driven so as to be turned about a mast-pivot-turn-axis parallel to the boom-pivot-turn-axis to raise and lower the boom. The boom has a boom body, a boom foot joined to a basal end of the boom body and adapted to be attached to the upper slewing body turnably about the boom-pivot-turn-axis, and a mast mounting portion joined to the basal end of the boom body. The mast has a basal end which includes a mast foot to be attached to the mast mounting portion turnably about the mast pivot-turn-axis.

In this raisable-lowerable member, the mast foot of the mast is attached not to the upper slewing body but to the mast mounting portion joined to the basal end of the boom, which allows the boom to be separated from the upper slewing body while the mast remains attached to the boom, thus enabling the mast and the boom to be transported together as a single unit. Hence, differently from the conventional crane, there is no need for attaching and detaching the mast with respect to the upper slewing body for each transportation. This results in a possibility of shortening a time required for assembling and disassembling of the crane.

It is preferable that: the boom includes a lower boom member including the boom foot, and a distal-end-side member located closer to a distal end of the boom than the lower boom member; the lower boom member is capable of being separated from the distal-end-side member; and the mast mounting portion is joined to a basal end of the lower boom member. This boom allows the lower boom member to be transported together with the mast remaining attached to the lower boom member, as a single unit, while the lower boom member has been separated from the distal-end-side member.

The mast mounting portion preferably includes a mast mounting bracket disposed so as to protrude from a basal end of the boom upwardly beyond a back side surface of the boom in a state where the boom is attached to the upper slewing body, lowered and laid down, wherein the mast foot of the mast is attached to the mast mounting bracket turnably about the mast pivot-turn-axis so as to allow the mast to be laid down on the back side surface of the boom. This mast mounting portion enables the mast attached to the mast mounting bracket to be transported together with the boom in such a stable posture that the mast is laid down on the back side surface of the boom.

The present invention is not limited to specific means for turning the mast. For example, preferable is that the above raisable-lowerable member further comprises: an upper spreader supported by a distal end of the mast to allow a rope to be reeved between the upper spreader and a lower spreader detachably mounted to the upper slewing body; a winch mounted to the mast or the boom to wind and unwind the rope having been reeved between the upper spreader and the lower spreader mounted to the upper slewing body to thereby turn the mast about the mast pivot-turn-axis; and a lower-spreader holding portion provided in the mast or the boom, the lower-spreader holding portion being capable of holding the lower spreader which has been detached from the upper slewing body. According to this raisable-lowerable member, it is possible to turn the mast about the mast pivot-turn-axis to cause the boom to be raised and lowered, during operation of the crane, by winding and unwinding the rope having been reeved between the lower spreader mounted to the upper slewing body and the upper spreader supported by the distal end of the mast, by the winch; on the other hand, during transportation of the raisable-lowerable member, it is possible to transport the winch, the upper and lower spreaders and the rope, in addition to the boom and the mast, together as a single unit by separating the lower spreader from the upper slewing body and making the lower-spreader holding portion hold the lower spreader. This allows detaching the rope from the upper and lower spreaders for the transportation to be not required, thereby enabling a time required for disassembling and assembling of the crane to be further shortened.

The present invention also provides a crane comprising a crane main body including an upper slewing body, and the above raisable-lowerable member. The boom foot of the boom in the raisable-lowerable member is adapted to be joined to the upper slewing body so as to allow the boom to be turned about the boom-pivot-turn-axis in the raising-lowering direction.

In this crane, the boom preferably includes a lower boom member including the boom foot, and a distal-end-side member located closer to a distal end of the boom than the lower boom member, the lower boom member being capable of being separated from the distal-end-side member, the mast mounting portion being joined to a basal end of the lower boom member.

In the above crane, it is preferable that: the mast mounting portion includes a mast mounting bracket located so as to protrude from a basal end of the boom upwardly beyond a back side surface of the boom in a state where the boom is attached to the upper slewing body, lowered and laid down; and the mast foot of the mast is attached to the mast mounting bracket turnably about the mast pivot-turn-axis so as to allow the mast to be laid down on the back side surface of the boom.

As means for turning the mast, for example, it is preferable that: the above crane further includes a rope for turning the mast and a lower spreader detachably mounted to the upper slewing body; and the raisable-lowerable member further includes an upper spreader supported by a distal end of the mast to allow the rope to be reeved between the upper spreader and the lower spreader mounted to the upper slewing body, a winch mounted to the mast or the boom to wind and unwind the rope having been reeved between the lower spreader and the upper spreader to thereby turn the mast about the mast pivot-turn-axis, and a lower-spreader holding portion provided in the mast or the boom, the lower-spreader holding portion being capable of holding the lower spreader which has been detached from the upper slewing body.

This application is based on Japanese Patent application No. 2013-014506 filed in Japan Patent Office on Jan. 29, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A raisable-lowerable member to be attached to an upper slewing body of a crane in a raisable and lowerable manner, comprising:

a boom attachable to the upper slewing body turnably about a boom-pivot-turn-axis in a raising-lowering direction; and a mast to be driven so as to be turned about a mast pivot-turn-axis parallel to the boom-pivot-turn-axis to raise and lower the boom, wherein:

the boom includes a boom foot adapted to be attached to the upper slewing body turnably about the boom-pivot-turn-axis and a mast mounting portion disposed on a basal end of the boom; and the mast has a basal end which includes a mast foot to be attached to the mast mounting portion of the boom turnably about the mast pivot-turn-axis.

2. The raisable-lowerable member as defined in claim 1, wherein: the boom includes a lower boom member including the boom foot, and a distal-end-side member located closer to a distal end of the boom than the lower boom member; the lower boom member is capable of being separated from the distal-end-side member; and the mast mounting portion is joined to a basal end of the lower boom member.

3. The raisable-lowerable member as defined in claim 2, wherein the lower boom member, the mast mounting portion joined to the lower boom member, and the mast attached to the mast mounting portion are separated from the upper slewing body and form a single unit to be transported integrally.

4. The raisable-lowerable member as defined in claim 1, wherein the mast mounting portion includes a mast mounting bracket disposed so as to protrude from the basal end of the boom upwardly beyond a back side surface of the boom in a state where the boom is attached to the upper slewing body, lowered and laid down, the mast foot of the mast being attached to the mast mounting bracket turnably about the mast pivot-turn-axis so as to allow the mast to be laid down on the back side surface of the boom.

5. The raisable-lowerable member as defined in claim 1, further comprising: an upper spreader supported by a distal end of the mast to allow a rope to be reeved between the upper spreader and a lower spreader detachably mounted to the upper slewing body; a winch mounted to the mast or the boom to wind and unwind the rope having been reeved between the upper spreader and the lower spreader mounted to the upper slewing body to thereby turn the mast about the mast pivot-turn-axis; and a lower-spreader holding portion provided in the mast or the boom, the lower-spreader holding portion being capable of holding the lower spreader which has been detached from the upper slewing body.

6. The raisable-lowerable member as defined in claim 5, wherein the boom including the boom foot and the mast mounting portion, the mast attached to the mast mounting portion, the upper spreader, the lower spreader, the rope, the winch, and the lower-spreader holding portion are separated from the user slewing body and form a single unit to be transported integrally.

7. A crane comprising: a crane main body including the upper slewing body and the raisable-lowerable member as defined in claim 1, wherein the boom foot of the boom in the raisable-lowerable member is adapted to be attached to the upper slewing body so as to allow the boom to be turned about the boom-pivot-turn-axis in the raising-lowering direction.

8. The crane as defined in claim 7, wherein: the boom includes a lower boom member including the boom foot, and a distal-end-side member located closer to a distal end of the boom than the lower boom member; the lower boom member is capable of being separated from the distal-end-side member; and the mast mounting portion is joined to a basal end of the lower boom member.

9. The crane as defined in claim 8, wherein the lower boom member, the mast mounting portion joined to the lower boom member, and the mast attached to the mast mounting portion are separated from the upper slewing body and form a single unit to be transported integrally.

10. The crane as defined in claim 7, wherein the mast mounting portion includes a mast mounting bracket disposed so as to protrude from the basal end of the boom upwardly beyond a back side surface of the boom in a state where the boom is attached to the upper slewing body, lowered and laid down, the mast foot of the mast being attached to the mast mounting bracket turnably about the mast pivot-turn-axis so as to allow the mast to be laid down on the back side surface of the boom.

11. The crane as defined in claim 7, further comprising a rope for turning the mast and a lower spreader detachably mounted to the upper slewing body, wherein the raisable-lowerable member further comprising: an upper spreader supported by a distal end of the mast to allow the rope to be reeved between the upper spreader and the lower spreader mounted to the upper slewing body; a winch mounted to the mast or the boom to wind and unwind the rope having been reeved between the upper spreader and the lower spreader to thereby turn the mast about the mast pivot-turn-axis; and a lower-spreader holding portion provided in the mast or the boom, the lower-spreader holding portion being capable of holding the lower spreader which has been detached from the upper slewing body.

12. The crane as defined in claim 11, wherein the boom including the boom foot and the mast mounting portion, the mast attached to the mast mounting portion, the upper spreader, the lower spreader, the rope, the winch, and the lower-spreader holding portion are separated from the upper slewing body and form a single unit to be transported integrally.

13. The crane as defined in claim 11, further comprising a lower-spreader mounting bracket disposed on the upper slewing body, wherein the lower spreader is detachably mounted to the lower-spreader mounting bracket of the upper slewing body.

14. The crane as defined in claim 7, wherein the boom including the boom foot and the mast mounting portion, and the mast attached to the mast mounting portion are separated from the upper slewing body and form a single unit to be transported integrally.

15. The raisable-lowerable member as defined in claim 1, wherein the mast mounting portion is disposed on the basal end of the boom at a location closer to a distal end of the boom than is the boom-pivot-turn-axis.

16. The raisable-lowerable member as defined in claim 15, wherein the boom including the boom foot and the mast mounting portion, and the mast attached to the mast mounting portion are separate from the upper slewing body and form a single unit to be transported integrally.

17. The raisable-lowerable member as defined in claim 1, wherein the boom including the boom foot and the mast mounting portion, and the mast attached to the mast mounting portion are separate from the upper slewing body and form a single unit to be transported integrally.

* * * * *